US006079813A

United States Patent [19]

Tuli

[11] Patent Number: 6,079,813

[45] Date of Patent: Jun. 27, 2000

[54] HIGH SPEED THIN FILM STRESSED MEMBRANE PRINT HEAD

[75] Inventor: Raja Singh Tuli, Montreal, Canada

[73] Assignee: Raja Tuli, Montreal, Canada

[21] Appl. No.: 08/958,618

[22] Filed: Oct. 27, 1997

[51] Int. Cl.[7] ..... B41J 2/04

[52] U.S. Cl. ..... 347/54

[58] Field of Search ..... 347/54, 55, 84, 347/103, 68, 70, 71, 154, 123, 111, 159, 127, 128, 17, 141, 120, 151; 399/271, 290, 292, 293, 294, 295

[56] References Cited

U.S. PATENT DOCUMENTS 5,825,383 10/1998 Abe et al. ..... 347/54

*Primary Examiner*—John Barlow
*Assistant Examiner*—Raquel Yvette Gordon

[57] ABSTRACT

This invention relates to a high speed print head for an inkjet printer which involves the integration of stressed thin film technology. The stressed thin film is applied over a basic substrate and some cavities are etched underneath the film creating a membrane film which has the tendency to bulge outward over cavity areas under the effect of its internal compressed forces. The membrane film, and the bottom of the cavity, have electrodes deposited. An electric signal corresponding with input data is applied to two electrodes creating an electric field between electrodes. As a result, the membrane film is attracted and repelled against the fixed cavity bottom, following the electric signal and providing a variation of an adjacent ink chamber's volume ejecting an ink drop. In its displacement, the membrane film snaps, after passing the zone where the force created by the electric field adds to the internal compressed forces of the film, accelerating its displacement from one stable position into another. This process acts in both directions of membrane movement. In a first embodiment of this invention, the ink drop is ejected perpendicular to the membrane displacement, while in the second embodiment the ink drop is ejected in a parallel direction to the membrane displacement. The invention increases the printing speed and quality, improves the ink flow and eliminates print head nozzles clogging, thus ensuring compatibility with different ink types, and also reducing the print head size and cost.

6 Claims, 11 Drawing Sheets

HIGH SPEED THIN FILM STRESSED MEMBRANE PRINT HEAD

BACKGROUND OF THE INVENTION

The present invention generally relates to a high speed print head for an inkjet printer which involves the integration of stressed thin film technology having improved print quality, print speed, and lower cost.

In prior art, ink jet print heads have been developed using heat to eject drops of ink fluid. Thermal ink jet print heads include an ink reservoir in a fluid communication with a print head substrate having a plurality of resistors. The resistors, conventionally, exist in an electrically conductive layer which is positioned on selected periods of the layer of resistive material. Selective electrical activation of the resistors causes a rapid boiling of the ink in the proximity of the activated resistors and expulsion of the ink from orifices (print head nozzles) in the print head. In all such print head devices, a major disadvantage is that after use, the heater elements accumulate residue from the boiled ink which reduces the heat transfer from the heater elements to the ink, in conjunction with clogging the nozzle jets. As a result, the consistency of print quality will be affected. Another major disadvantage is that the ink must be water based which reduces the printer's compatibility with different ink types.

In other prior art, piezoelectric elements are used to produce an improved printing system. A piezoelectric print head usually comprises a fluid chamber supplied with fluid ink and having a nozzle orifice. A piezoelectric element array is mounted adjacent to the fluid chamber. Selective operation of the printing apparatus is provided by energizing the piezoelectric elements in response to an electrical signal to reduce the volume in the fluid chamber and to force a single drop of ink from the nozzle orifice to be ejected. A major disadvantage of this system is that the piezoelectric element must have a large surface area to displace enough ink volume, since the piezoelectric elements which deform upon application of a voltage have a very small displacement. This results in a large cumbersome size with a high cost of manufacturing.

To resolve these problems, a modern design of high speed print head is provided. This new design increases the printing speed and quality, improves the ink flow and eliminates the print head nozzles clogging, thus ensuring compatibility with different ink types and reducing the print head sizes and cost.

SUMMARY OF THE INVENTION

In the present invention a high speed print head using stressed thin film technology is provided.

In a first process, a film is applied over a basic substrate to create stress in the film due to internal compressed forces.

In a second process, some cavities are etched underneath the film, creating a membrane film in the cavity areas. After these cavities are etched, the membrane film has a tendency to bulge outward over cavity areas under the effect of its internal compressed forces. Therefore, the membrane film is in a higher outward bulged position versus its flat position. This outward bulged film has the capacity to be pressed into a lower inward bulged position opposite to the outward bulged position.

The membrane film and the bottom of the cavity are each deposited with electrodes, such that an electric signal corresponding to input data applied to these electrodes, produces an electric field between them.

As a result, following the electric signal, the electrodes are attracted or repelled due to the electric field variation, causing the membrane film to move inward or outward within the fixed cavity bottom.

Furthermore, in its displacement, the membrane film snaps after passing a zone where forces created by the electrical field adds to the internal compressed forces of the film, accelerating its displacement from a stable outward bulged position to another stable inward bulged position.

When the electrical field changes its polarity following the input data, the membrane film starts its reversed displacement, from its lower inward bulged position to the first higher outward bulged position. In its displacement, the membrane film snaps after passing a second zone where forces created by the electrical field adds to the internal compressed forces of the film, accelerating the membrane displacement.

The basic substrate with the stressed film is mounted adjacent to an ink chamber, whereby a displacement of the bulged film surface area reduces the volume of the ink chamber, forcefully ejecting an ink drop through a nozzle.

In a first embodiment of this invention, the direction of the membrane film displacement is perpendicular to the ink ejection direction, while in a second embodiment of this invention, the direction of the membrane film displacement is parallel to the ink ejection direction.

BRIEF DESCRIPTION OF DRAWINGS

The following drawings will assist the reader in understanding the numerous objects and advantages of this invention.

DESCRIPTION OF PREFERRED EMBODIMENTS

Here is a detailed description of preferred embodiments related to a high speed printer head using a stressed thin film technology.

Figure 1:
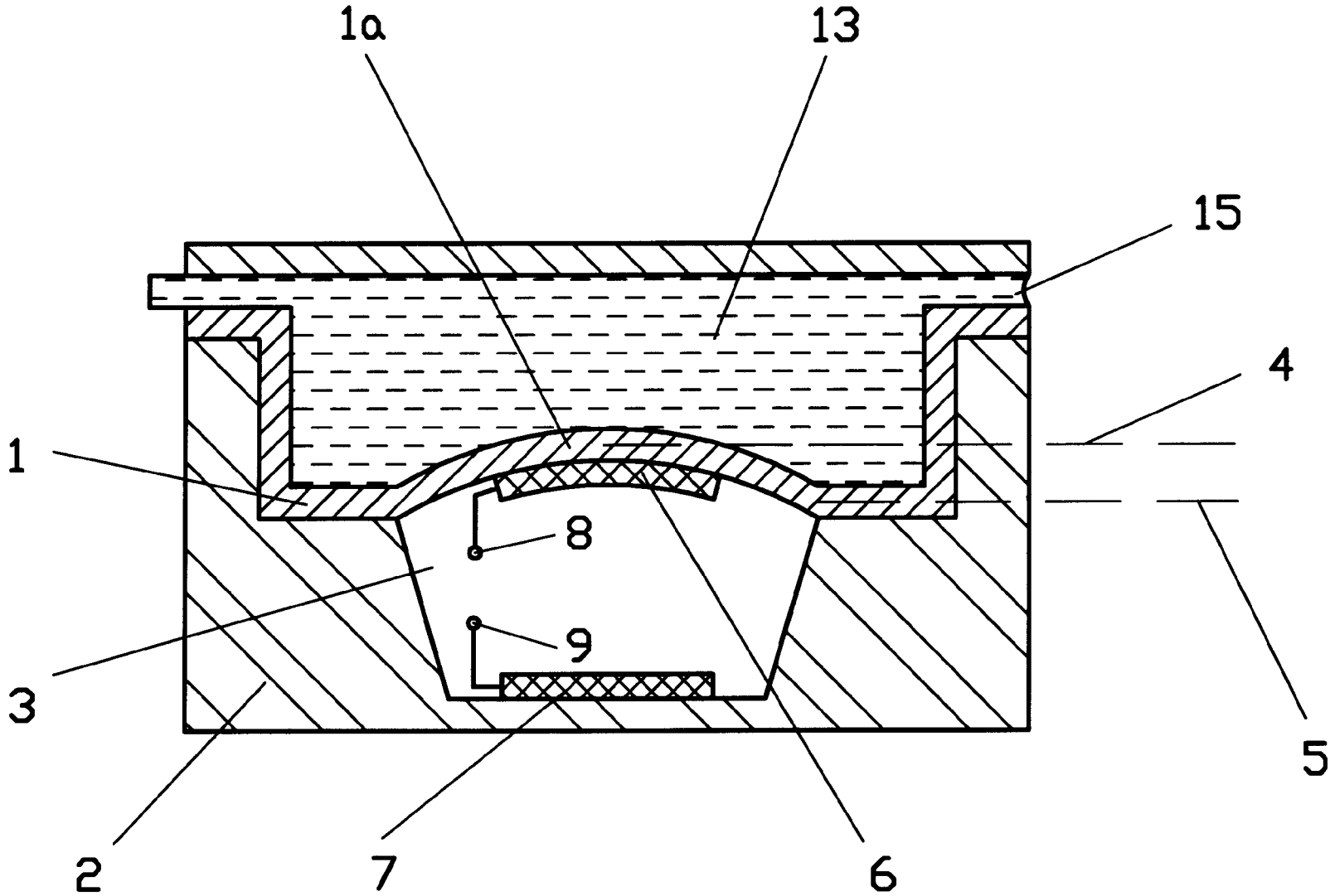
FIG. 1 illustrates a sectional view through a cavity in the basic substrate corresponding with the first embodiment of this invention. A stressed film exist over the cavity constituting a membrane film which is in a first stable higher outward bulged position. The membrane film and the bottom of the cavity have deposited electrodes. In this first stable position of the membrane film, there is no electric voltage applied to electrodes, respectively no electric field exist between them. The basic substrate with the stressed film is mounted adjacent to an ink chamber. which have a nozzle located on one side of the ink chamber such that the direction of nozzle's ink ejection from the ink chamber is perpendicular to the membrane film displacement direction.

For a better understanding of the invention, reference is first made to FIG. 1, which represents the layout of principal elements within the first embodiment of the invention.

In a first process a film 1 is applied over a basic substrate 2 such that there is a stress in the film due to internal compressed forces.

In a second process some cavities 3 are etched underneath the film 1, creating a membrane film 1*a* in the cavity areas. After these cavities 3 are etched, the film 1 has a tendency to bulge outward over cavity areas under the effect of its internal compressed forces. Therefore the membrane film 1*a* is in an initial higher outward bulged position 4 versus a flat position 5 of the film 1.

The membrane film 1*a*, also the bottom of the cavity 3, have electrodes deposited 6 and 7 connected to some electric connectors 8 and 9.

Figure 2:
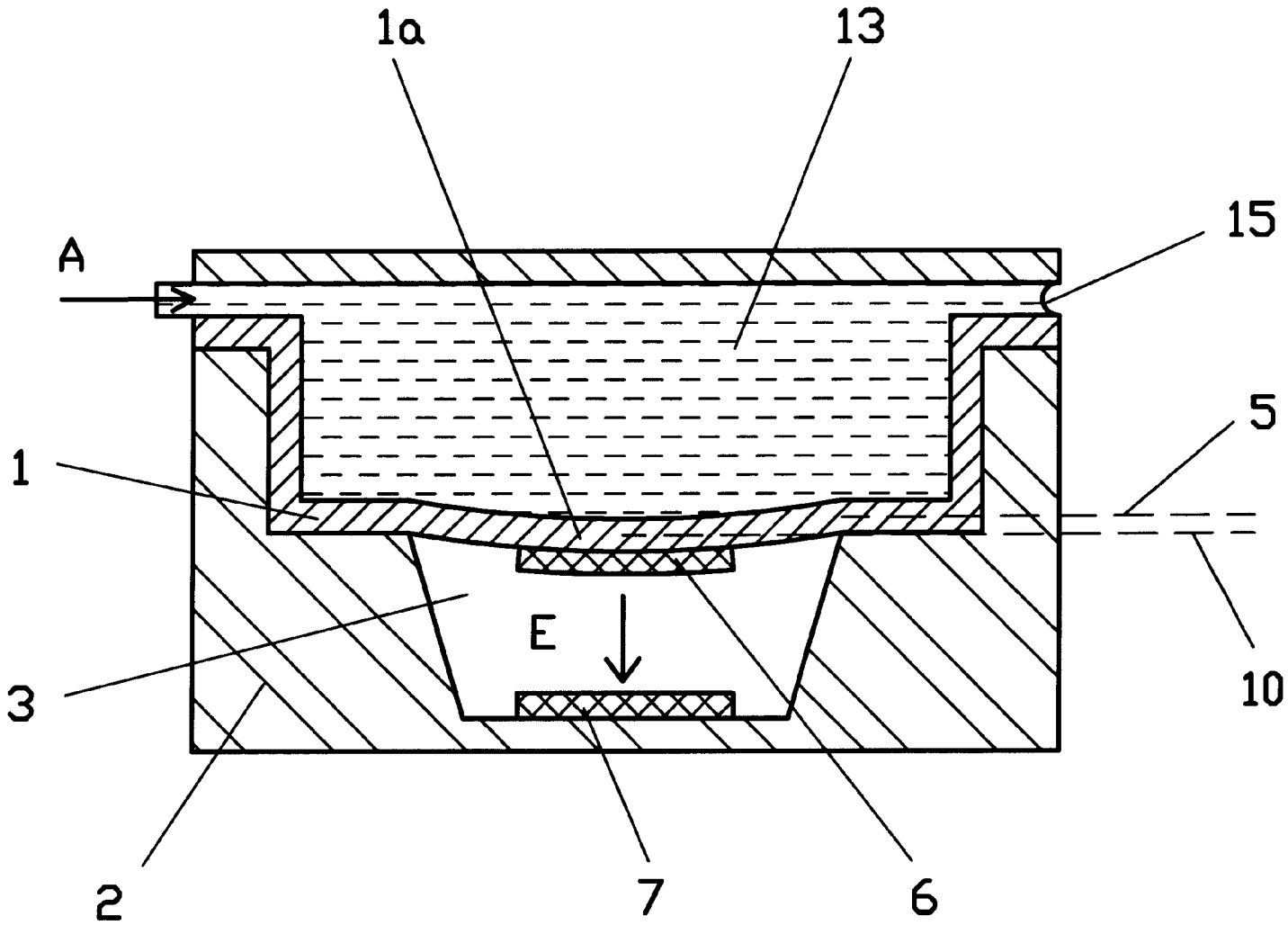
FIG. 2 illustrates the displacement of the membrane film due to an electrical field applied to the electrodes, moving from the first stable higher outward bulged position towards a second lower inward bulged position (of FIG. 3). This displacement is presented in an intermediate position, where the membrane film begins to snaps.

The functioning of the device is represented in FIGS. 2–5 as follows:

In FIG. 2, an electrical signal V (first diagram in FIG. 11), corresponding with an input data, is applied to each of electrodes 6 and 7 to produce an electric field E between these two electrodes.

As a result, following the electrical signal V having a positive value +V, as the electrodes 6 and 7 are attracted due to a resultant electric field +E, the membrane film 1*a* displaces (on vertical axis D in the second diagram of FIG. 11) from its initial higher outward bulged position 4 of FIG. 1 (corresponding with point S1 on the second diagram of FIG. 11) inward to the cavity 3. In its displacement, the membrane film 1*a* snaps, after passing a zone corresponding with a first snap position 10 (point S2 of the second diagram of FIG. 11), where forces created by the electrical field adds to the internal compressed forces of the film, accelerating the membrane film 1*a* displacement to another stable lower inward bulged position 11 of FIG. 3 (point S3 on the second diagram of FIG. 11).

Figure 4:
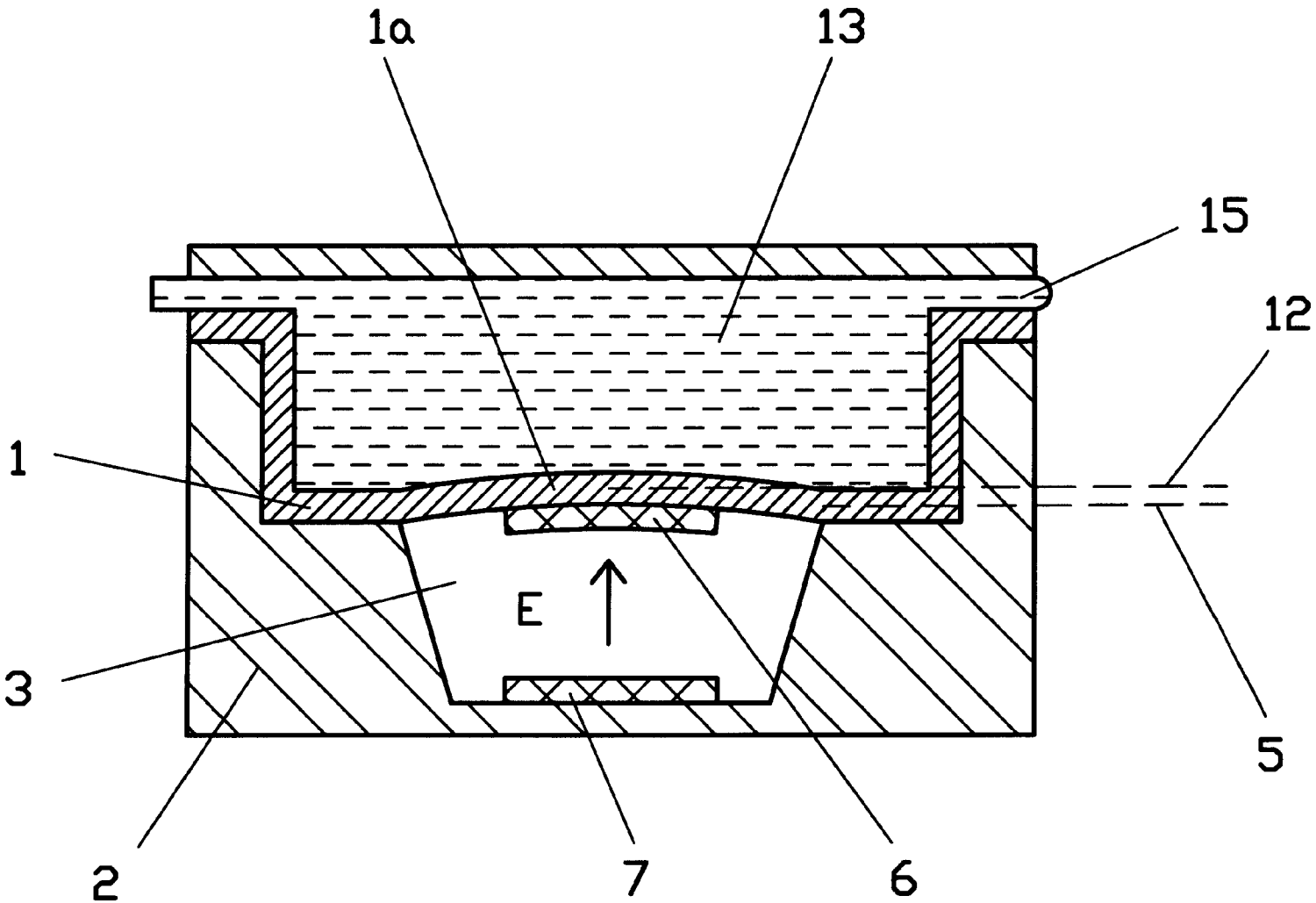
FIG. 4 illustrates the displacement of the membrane film due to an reversed electrical field applied to the electrodes, from the second stable lower inward bulged position to the first stable higher outward bulged position. This displacement is in an intermediate position, where the membrane film begins to snaps.
Figure 5:
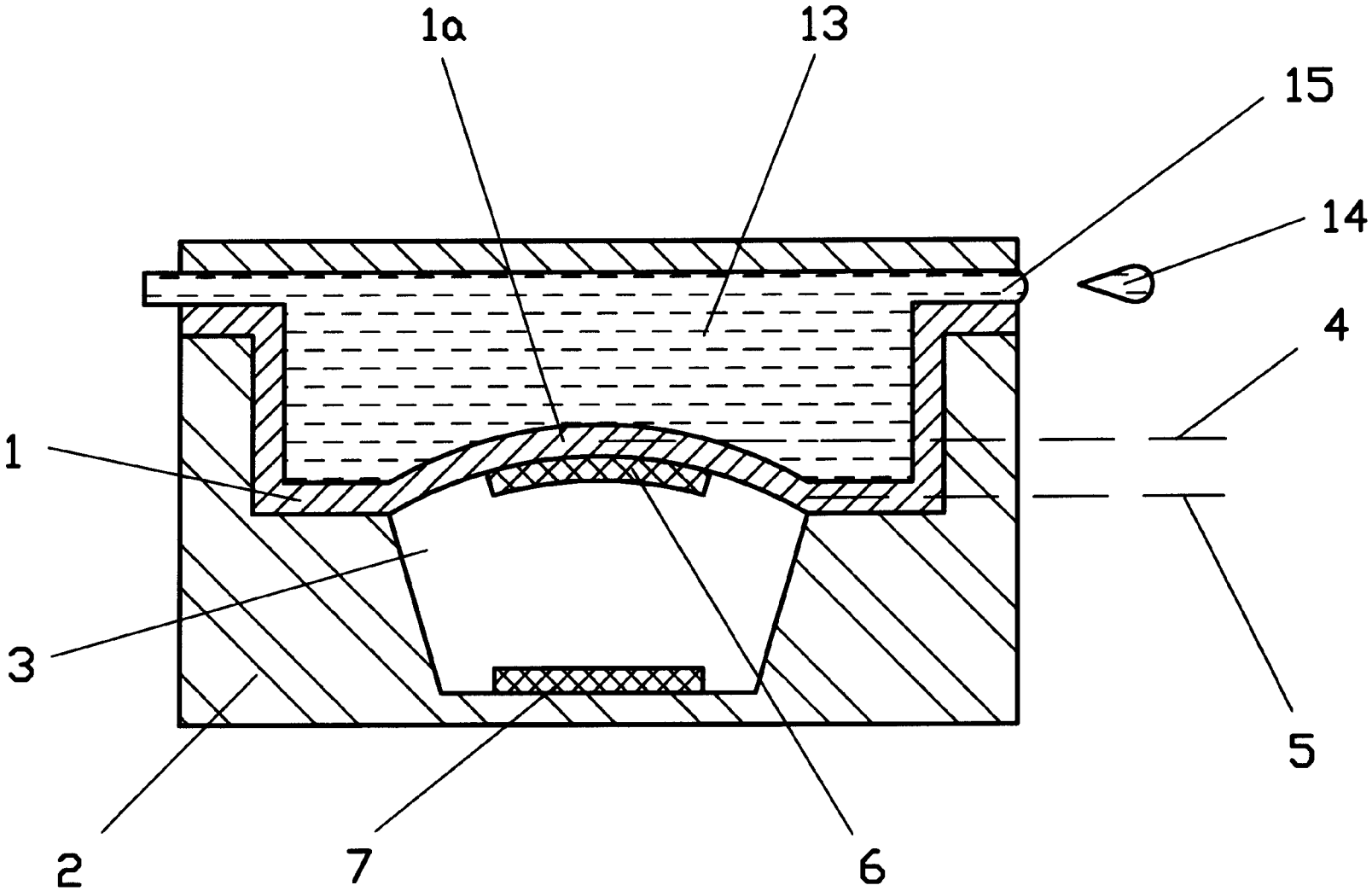
FIG. 5 illustrates the membrane film, back to its first higher outward bulged position, and the ejection of an ink drop, perpendicular to the membrane displacement direction, through a printer nozzle located on one side of the ink chamber.

In reference to FIG. 4, when the electric signal V changes its polarity, the electric field E reverts its sense, and therefore the electrode 6 becomes repelled by the fixed electrode 7, and membrane film 1*a* begins reversing its displacement from its lower inward bulged position 11 to its higher outward bulged position 4 of FIG. 1. In its displacement, the membrane film 1*a* snaps after passing a zone corresponding with a second snap position 12, where forces created by the electrical field adds to the internal compressed forces of the film, accelerating the membrane film 1*a* displacement to the first stable higher outward bulged position 4 of FIG. 5.

The basic substrate 2, with the stressed film 1 is mounted adjacent to an ink chamber 13 where the reverse displacement of the membrane film 1*a* from its lower inward bulged position 11 to its higher outward bulged position 4 reduces the volume of the ink chamber 13, increasing the pressure therein to eject an ink drop 14 (FIG. 5) through a printer nozzle 15 disposed on one side of the ink chamber 13. The direction of the membrane film 1*a* displacement is perpendicular to the ink ejection direction.

Figure 11:
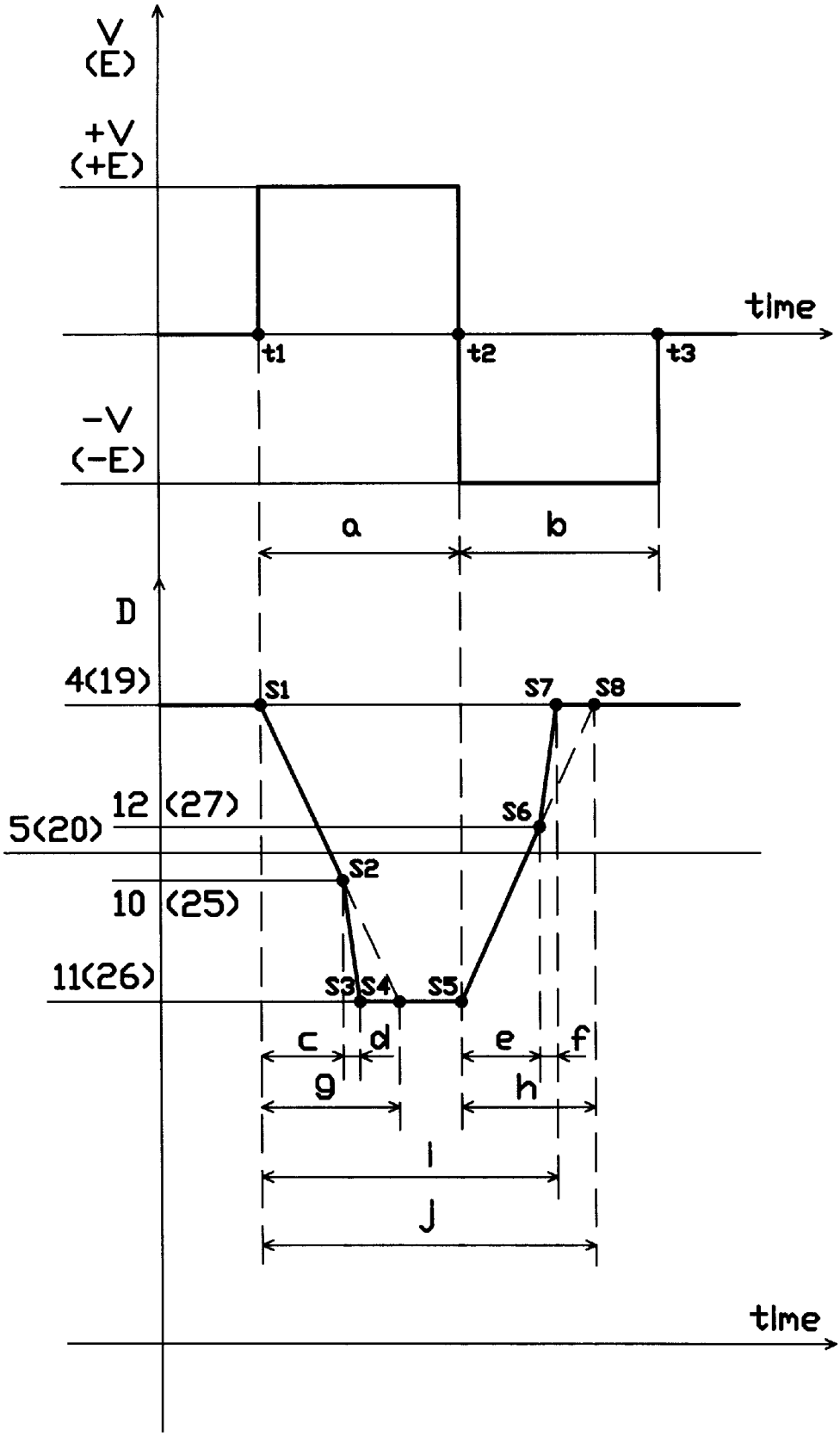
FIG. 11 illustrates in the first diagram the variation in time of the electrical signal, respectively of the electric field, applied to the electrodes, corresponding to the input data; whereby in the second diagram of FIG. 11 is represented the displacement of the membrane film following the electric field variation corresponding to the first diagram.

FIG. 11 illustrates in the first diagram, the variation of the electric signal V with time, with corresponding variation of the electric field E with time, applied to the electrodes 6 and 7, corresponding to input data.

The second diagram of FIG. 11 represents the displacement of the membrane film 1*a* corresponding to the electric field E variation with time of the first diagram, as follows:

When the electric signal +V is applied to the electric connectors 8 and 9 of FIG. 1 (for a period a from time t1 to time t2 on the first diagram of FIG. 11), an electric field +E appears between the electrodes 6 and 7. Such said electrodes attract each other, and the membrane film 1*a* begins its displacement in a linear mode from point S1 to S2 (period c in the second diagram of FIG. 11).

When the membrane film 1*a* arrives to position 10 corresponding to point S2 on second diagram, and where the forces created by the electric field adds to the internal compressed forces of the film, the membrane film 1*a* snaps, and accelerates its displacement to the lower inward bulged position 11 (period d in the second diagram of FIG. 11). In the meantime, an ink supplement represented by the arrow A enters the ink chamber 13, due to a negative pressure created by the inward displacement of the membrane film 1*a* which increase the volume of said ink chamber (FIG. 2).

Figure 3:
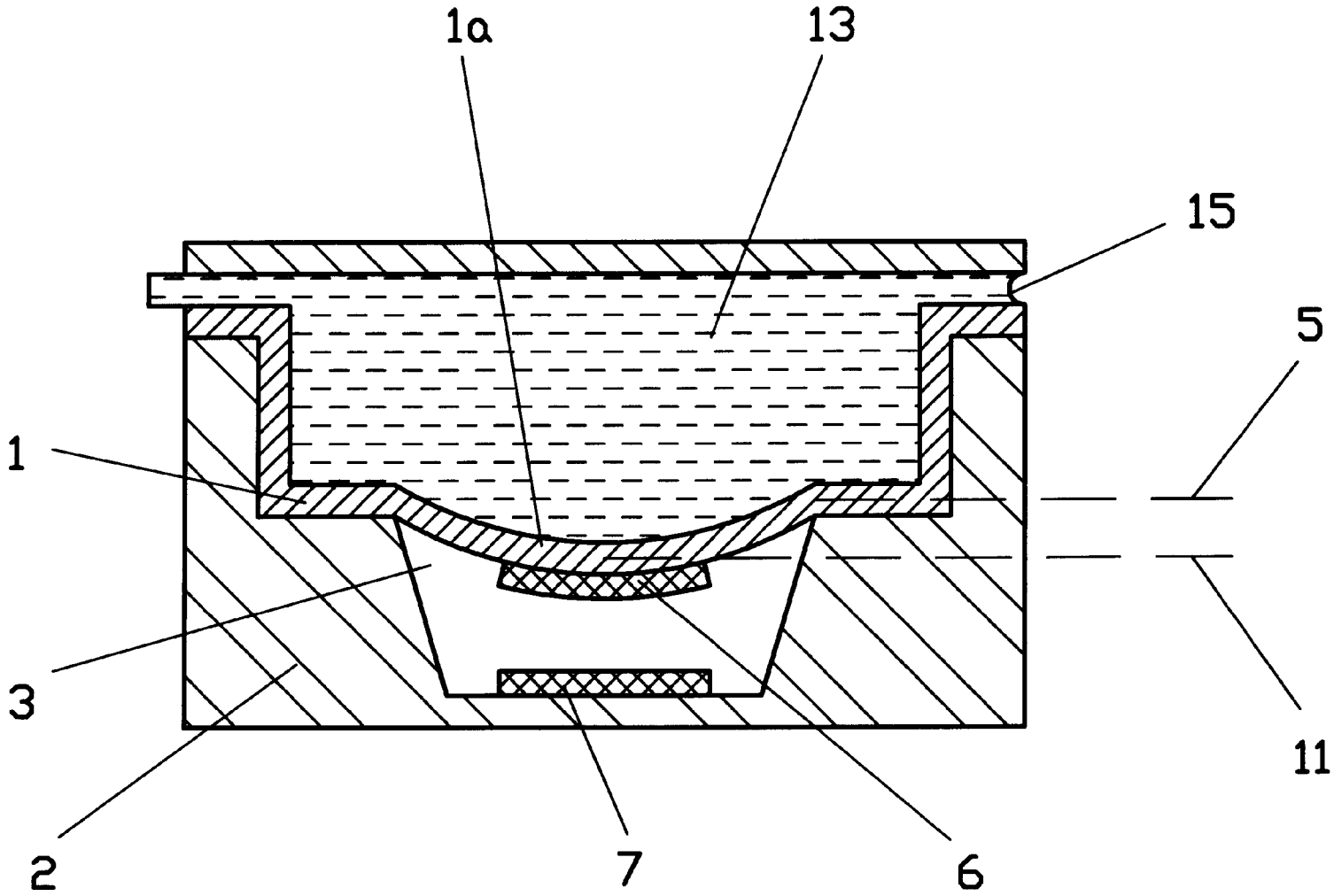
FIG. 3 illustrates the membrane film displaced due to the electrical field being applied to the electrodes, in the second stable lower inward bulged position.

The membrane film 1*a* remains in its lower stable position 11 of FIG. 3 trough the period S3 to S5 of FIG. 11.

As the result of the electric signal +V changing to −V, the electric field +E changes its polarity to −E (for a period b, from time t2 to time t3 on the first diagram of FIG. 11) and the electrodes 6 and 7 start to repel each other. This then causes the membrane film 1*a* start to reverse its displacement from its lower inward stable position 11 of S5.

After the membrane film 1*a* starts its second linear displacement from a lower departure point S5 (period e in the second diagram of FIG. 11), the said membrane reaches the second snap position 12 (FIGS. 4 and 11), corresponding with a second snap point S6, accelerating its displacement to the higher outward bulged position 4 (period f in the second diagram of FIG. 11), corresponding to point S7. This acceleration is due to internal compression forces of membrane film 1*a*. As a result, the pressure in the ink chamber 13 increases and the ink drop 14 is ejected trough the printer nozzle 15.

In the classical solutions without the snapping feature, the membrane film 1*a* would moves in a first linear displacement from point S1 to a point S4 (period g in the second diagram of FIG. 11) which is longer than the period c+d characteristic for this invention.

In the same classical solutions without the snapping feature, the membrane film 1*a* would reverse its movement in a second linear displacement from the point S5 to a point S8 (period h in the second diagram of FIG. 11) which is also longer than the period e+f characteristic for this invention.

As a result, a total response period specific for this invention (period i in the second diagram of FIG. 11) is shorter than the response period characteristic for the classical solutions (period j in the second diagram of FIG. 11).

Figure 6:
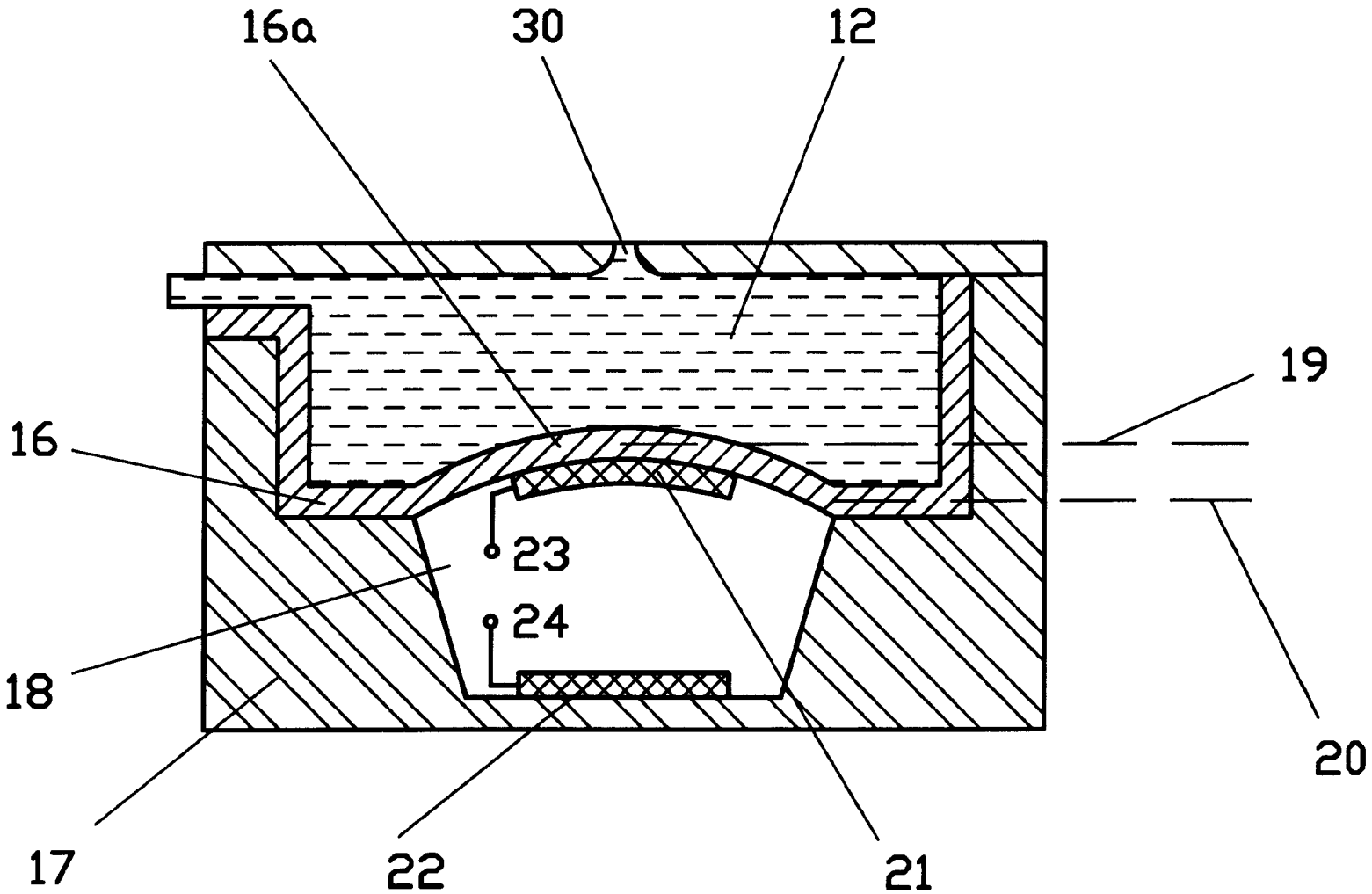
FIG. 6 illustrates a sectional view through a cavity in the basic substrate, corresponding with the second embodiment of this invention. A stressed film exist over the cavity constituting a membrane film which is in a first stable higher outward bulged position. The membrane film and the bottom of the cavity have deposited electrodes. In this first stable position of the membrane film, there is no electric voltage applied to electrodes, respectively no electric field exist between them. The basic substrate with the stressed film is mounted adjacent to an ink chamber. which have a nozzle located on other side of the ink chamber such that the direction of nozzle's ink ejection from the ink chamber is parallel to the membrane film displacement direction.

FIG. 6 represents the layout of principal elements within the second embodiment of the invention.

In a first process a film 16 is applied over a basic substrate 17 such that there is a stress in the film due to internal compressed forces.

In a second process some cavities 18 are etched underneath the film 16, creating a membrane film 16*a* in the cavity areas. After these cavities 18 are etched, the film 16 has a tendency to bulge outward over cavity areas under the effect of its internal compressed forces. Therefore membrane film 16*a* is in an initial higher outward bulged position 19 versus a flat position 20 of the film 16.

The membrane film 16*a*, also the bottom of the cavity 18, have electrodes deposited 21 and 22 connected to some electric connectors 23 and 24.

Figure 7:
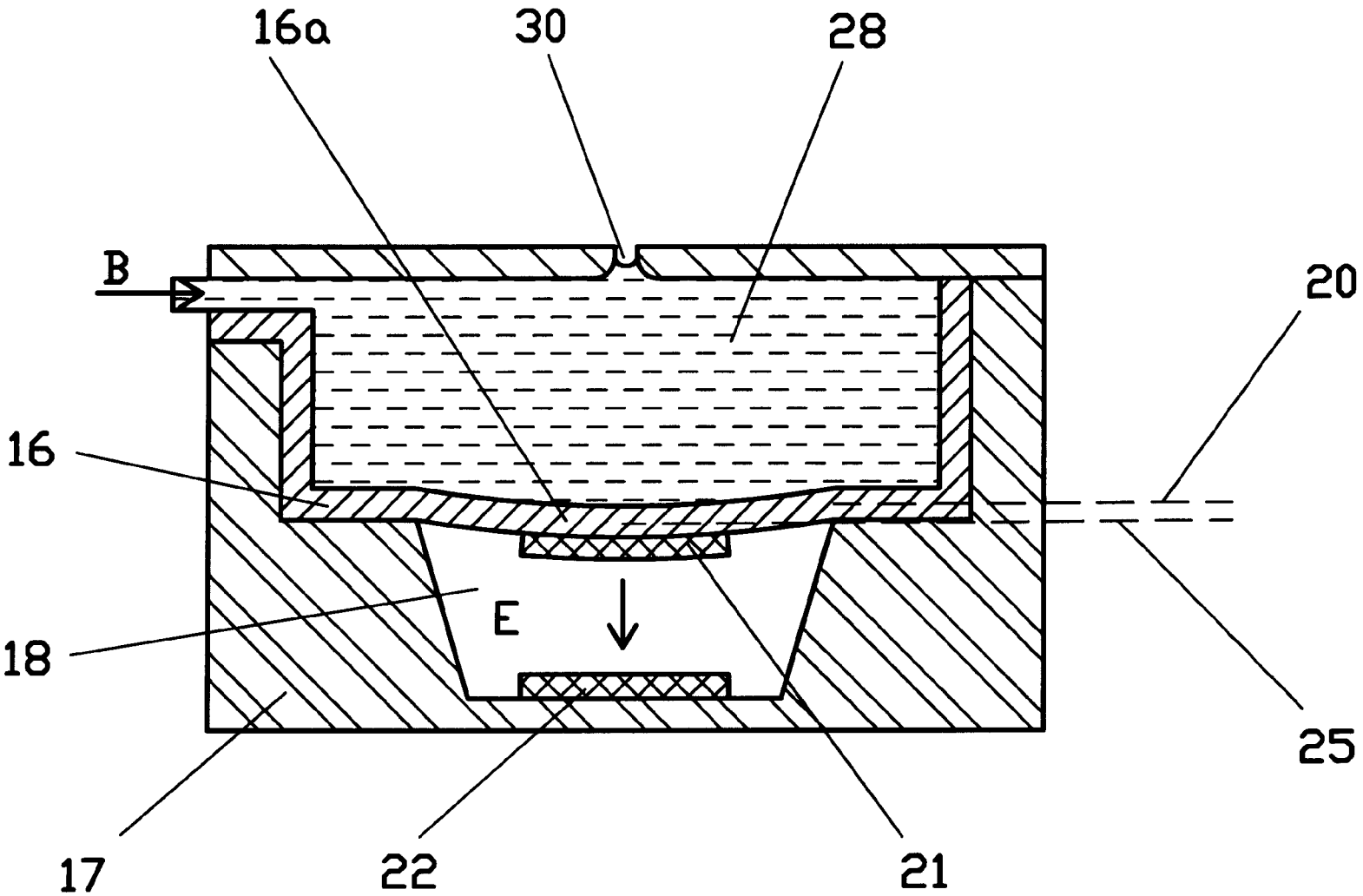
FIG. 7 illustrates the displacement of the membrane film due to an electrical field applied to the electrodes, moving from a first stable higher outward bulged position towards a second lower inward bulged position (of FIG. 8) This displacement is in an intermediate position, where the membrane film begins to snaps.

The functioning of the device is represented in FIGS. 7–10 as follows:

In FIG. 7, an electrical signal V (first diagram in FIG. 11), corresponding with an input data, is applied to each of electrodes 21 and 22, to produce an electric field E between these two electrodes.

As a result, following the electrical signal V having a positive value +V, as the electrodes 21 and 22 are attracted due to a resultant electric field +E, the membrane film 16*a* displaces (on vertical axis D in the second diagram of FIG. 11) from its initial higher outward bulged position 19 of FIG. 6 (corresponding with point S1 on the second diagram of FIG. 11) inward to the cavity 18. In its displacement, the membrane film 16*a* snaps, after passing a zone corresponding with a first snap position 25 (point S2 of the second diagram of FIG. 11), where forces created by the electrical field adds to the internal compressed forces of the film, accelerating the membrane film 16*a* displacement to another stable lower inward bulged position 26 of FIG. 8 (point S3 on the second diagram of FIG. 11).

Figure 9:
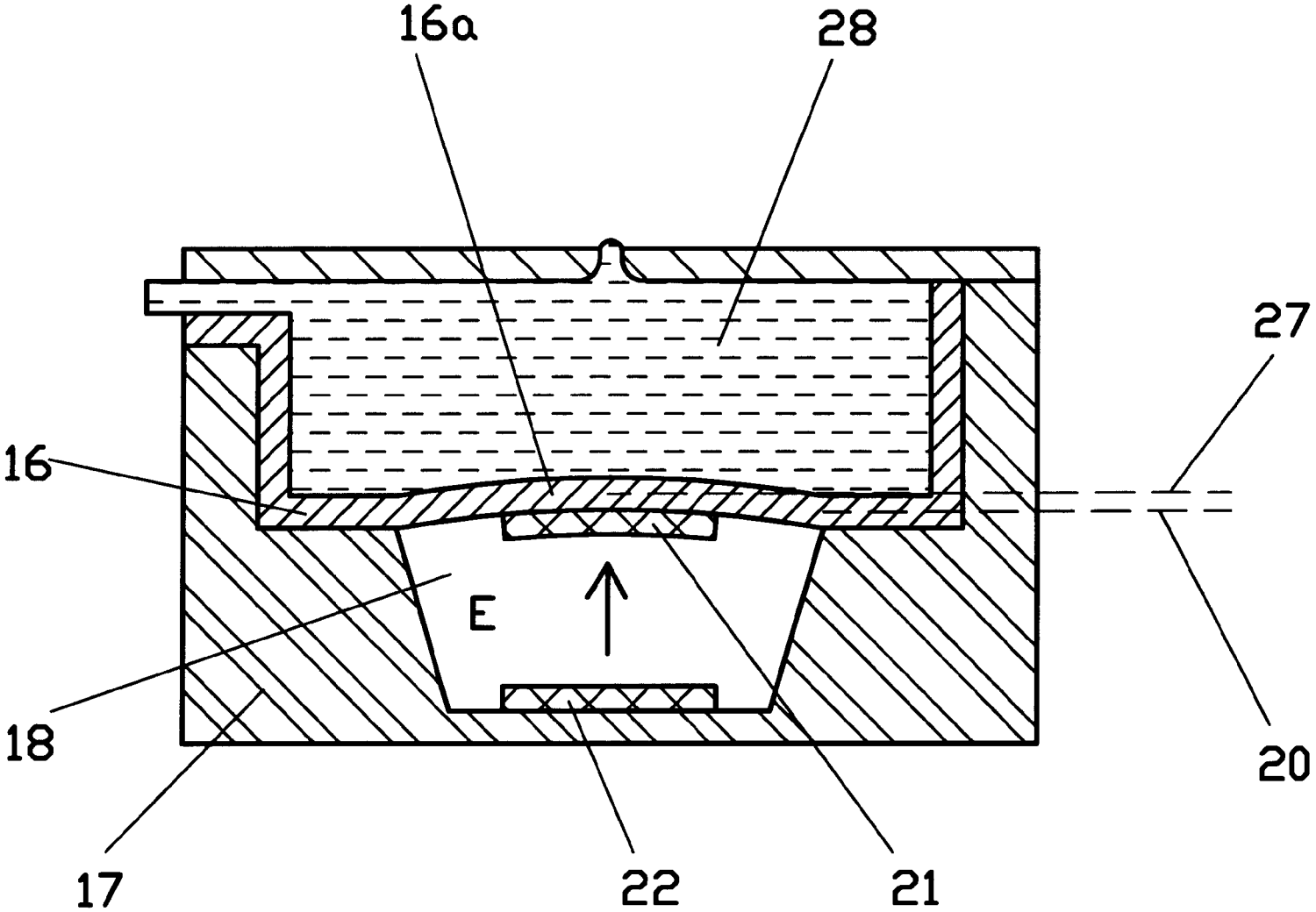
FIG. 9 illustrates the displacement of the membrane film due to an reversed electrical field applied to the electrodes, from the second stable lower inward bulged position to the first stable higher outward bulged position. This displacement is in an intermediate position, where the membrane film begins to snaps.
Figure 10:
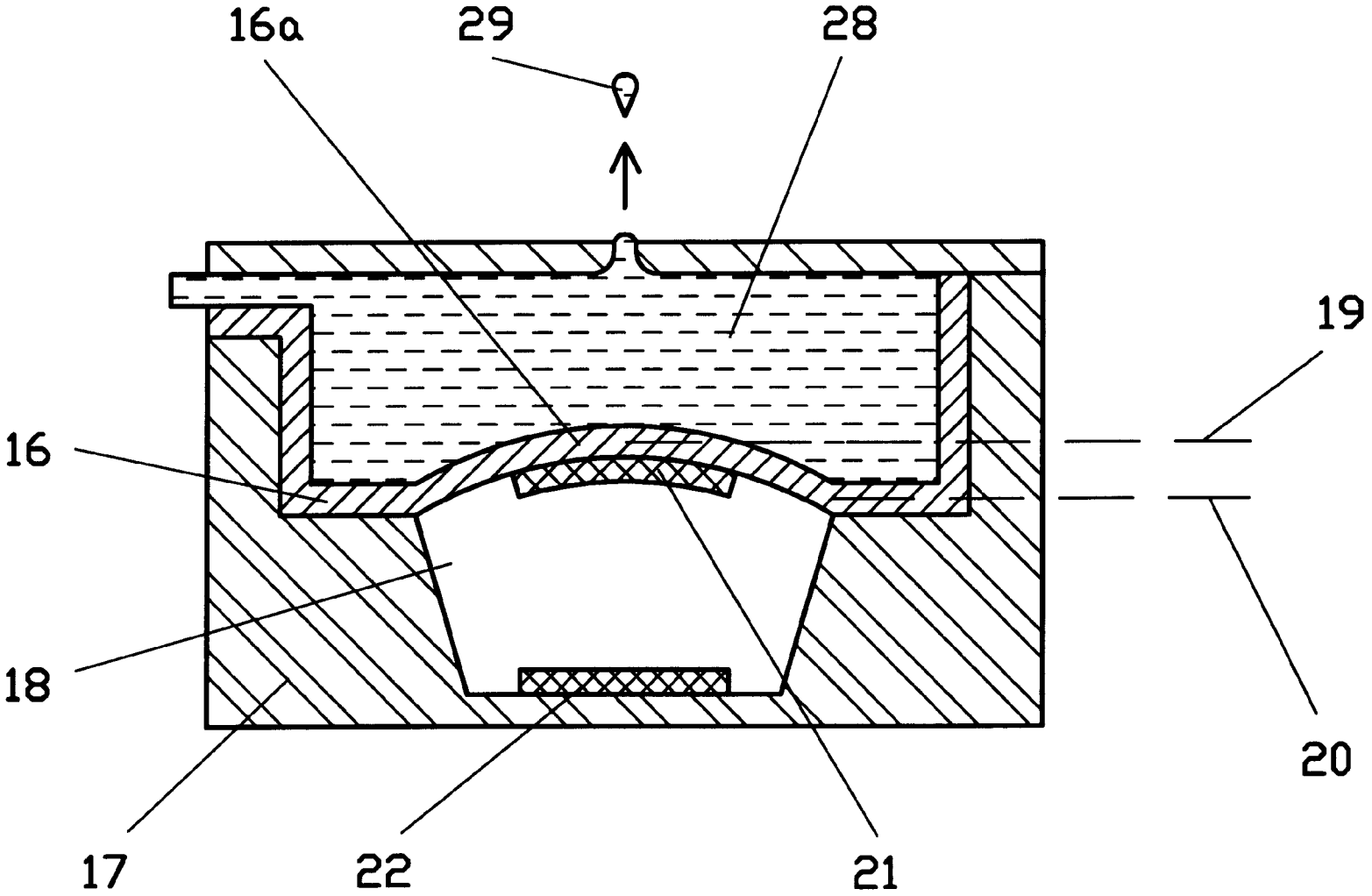
FIG. 10 illustrates the membrane film, back to its first higher outward bulged position, and the ejection of an ink drop, parallel to the membrane displacement direction, through a printer nozzle located on other side of the ink chamber.

In reference to FIG. 9, when the electric signal V changes its polarity, the electric field E reverts its sense and therefore the electrode 21 becomes repelled by the fixed electrode 22, and membrane film 16*a* begins reversing its displacement from its lower inward bulged position 26 to its higher outward bulged position 19 of FIG. 6. In its displacement, the membrane film 16*a* snaps (FIG. 9), after passing a zone corresponding with a second snap position 27, where forces created by the electrical field +E adds to the internal compressed forces of the film, accelerating the film displacement to the first stable higher outward bulged position 19 of FIG. 10.

The basic substrate 17, with the stressed film 16 is mounted adjacent to an ink chamber 28 where the reverse displacement of the membrane film 16*a* from its lower inward bulged position 26 to its higher outward bulged position 19 reduces the volume of the ink chamber 28, increasing the pressure therein to eject an ink drop 29 (FIG. 10) through a printer nozzle 30 disposed on top of the ink chamber 28. The direction of the membrane film 16*a* displacement is parallel to the ink ejection direction.

FIG. 11 illustrates in the first diagram, the variation of the electric signal V with time, with corresponding variation of the electric field E with time, applied to the electrodes 21 and 22, corresponding with input data.

The second diagram of FIG. 11 represents the displacement of the membrane film 16*a* corresponding to the electric field E variation with time of the first diagram, as follows:

When the electric signal +V is applied to the electric connectors 23 and 24 of FIG. 6 (for a period a from time t1 to time t2 on the first diagram of FIG. 11), an electric field +E appears between the electrodes 21 and 22. Such said electrodes attract each other, and the membrane film 16*a* begins its displacement in a linear mode from point S1 to S2 (period c in the second diagram of FIG. 11).

When the membrane film 16*a* arrives to position 25 corresponding to point S2 on second diagram, and where the forces created by the electric field adds to the internal compressed forces of the film, the membrane film 16*a* snaps, and accelerates its displacement to the lower inward bulged position 26 (period d in the second diagram of FIG. 11). In the meantime, an ink supplement represented by the arrow B enters the ink chamber 28, due to a negative pressure created by the inward displacement of the membrane film 16*a* which increase the volume of said ink chamber (FIG. 7).

Figure 8:
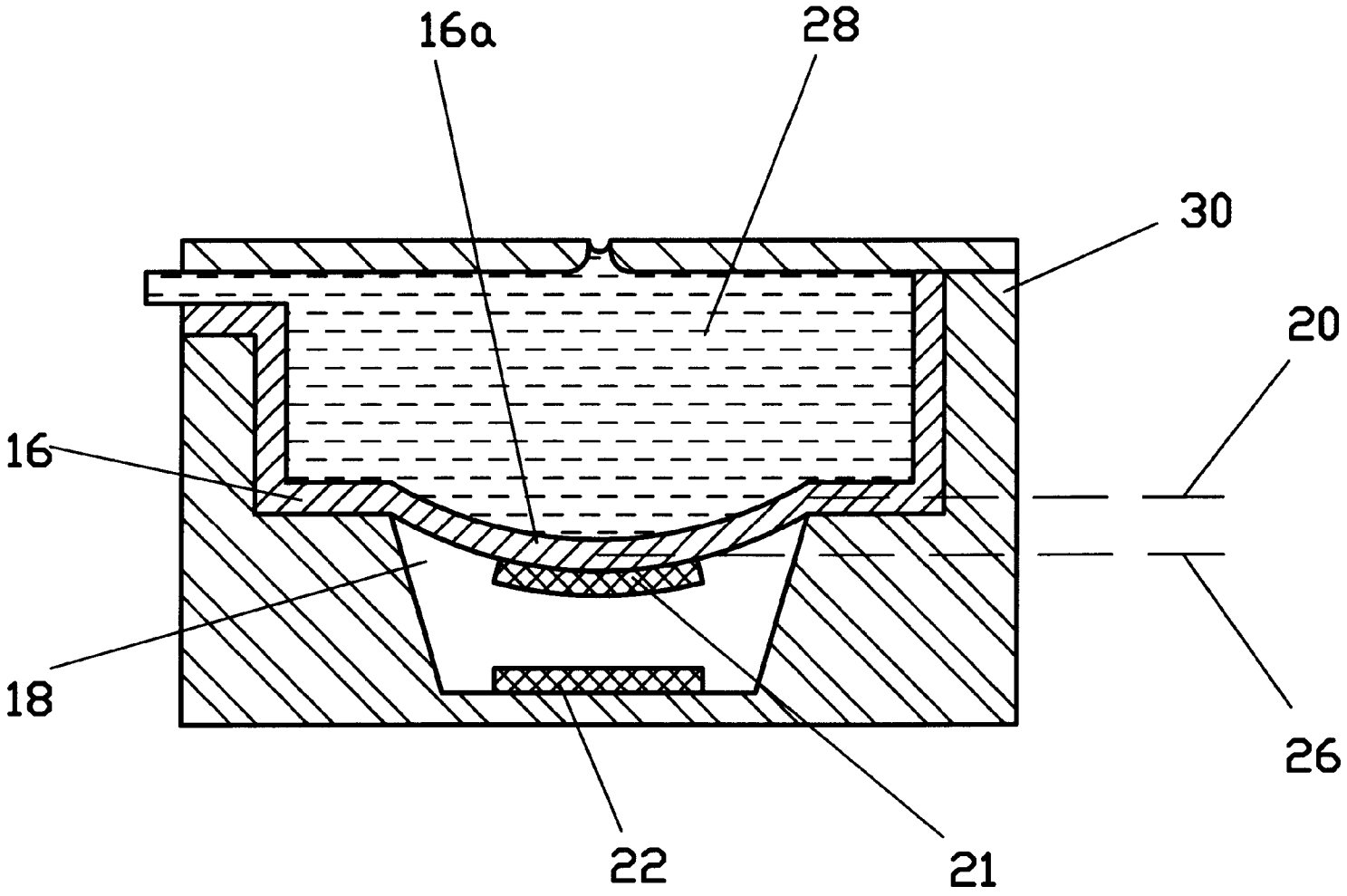
FIG. 8 illustrates the membrane film displaced due to the electrical field being applied to the electrodes, in the second stable lower inward bulged position.

The membrane film 16*a* remains in its lower stable position 26 of FIG. 8 trough the period S3 to S5 of FIG. 11.

As the result of the electric signal +V changing to −V, the electric field +E changes its polarity to −E (for a period b, from time t2 to time t3 on the first diagram of FIG. 11) and the electrodes 21 and 22 start to repel each other. This then causes the membrane film 16*a* start to reverse its displacement from its lower inward stable position 26 of S5.

After the membrane film 16*a* starts its second linear displacement from a lower departure point S5 (period e in the second diagram of FIG. 11), the said membrane reaches the second snap position 27 (FIG. 9 and 11), corresponding with a second snap point S6, accelerating its displacement to the higher outward bulged position 19 (period f in the second diagram of FIG. 11), corresponding to point S7. This acceleration is due to internal compression forces of membrane film 16*a*. As a result, the pressure in the ink chamber 28 increases and the ink drop 29 is ejected trough the printer nozzle 30.

In the classical solutions without the snapping feature, the membrane film 16*a* would moves in a first linear displacement from point S1 to a point S4 (period g in the second diagram of FIG. 11) which is longer than the period c+d characteristic for this invention.

In the same classical solutions without the snapping feature, the membrane film 16*a* would reverse its movement in a second linear displacement from the point S5 to a point S8 (period h in the second diagram of FIG. 11) which is also longer than the period e+f characteristic for this invention.

As a result, a total response period specific for this invention (period i in the second diagram of FIG. 11) is shorter than the response period characteristic for the classical solutions (period j in the second diagram of FIG. 11).

In conclusion, this invention uses a quick response device providing high speed printing and a versatile utilization of inks.

It is also understood that the following claims are intended to cover all the general and specific features of the invention herein described, and all statements of the scope of the invention which, as a matter of language, might be said to fall therebetween.

I claim:

1. A high speed print head for an inkjet printer in which:

a film used to push ink out through a nozzle is formed such that it has a higher bulged stable position when no forces are applied;

forces are applied to pull the film from its higher bulged stable position to a lower position;

as forces are released or reversed, internal compression forces formed in the film due to it being pulled into a lower position act further to push the film towards its higher bulged stable position, thus pushing ink out through a nozzle.

2. A high speed print head for an inkjet printer as claimed in claim 1 such that:

a film is applied over a basic substrate in a first flat position, to create stress in the film due to internal compressed forces;

cavities are etched underneath the film;

as a result of said etching, the film is bulged over cavity areas creating a membrane film which is in a higher outward bulged position versus the first flat position;

the membrane film has the capacity to be pressed into a lower inward bulged position opposite toward the higher outward bulged position.

3. A high speed print head as claimed in claim 1, in which:

the membrane film and the bottom of the cavity are each deposited with electrodes such that an electric signal, which corresponds to an input data is applied to these electrodes producing an electric field between them;

following the electric signal, the electrodes are attracted or repelled due to the electric field variation, causing the membrane film to displace inward and outward within the fixed cavity bottom.

4. A high speed print head as claimed in claims 1 and 3, in which:

when the electrical field is applied following the input data, the membrane film starts its displacement from the higher bulged stable position to the lower position;

in its displacement, the membrane film snaps after passing a zone where forces created by the electrical field adds to the internal compressed forces of the film, accelerating its displacement from the higher bulged stable position to the lower position;

when the electrical field changes its polarity following the input data, the membrane film starts a reversed displacement, from the lower position to the higher bulged stable position;

the membrane film snaps after passing a second zone, where forces created by the electrical field add to the internal compressed forces of the film, accelerating the membrane displacement to the higher bulged stable position;

the basic substrate with the stressed film is mounted adjacent to an ink chamber whereby a displacement of the bulged film surface area, from the lower position to the higher bulged stable position reduces the volume of the ink chamber, forcefully ejecting an ink drop through a nozzle.

5. A high speed print head as claimed in claim 4 in which:

in a first embodiment, the nozzle is disposed on one side of the ink chamber and the direction of the membrane film displacement is perpendicular to the ink ejection direction.

6. A high speed print head as claimed in claim 4 in which:

in a second embodiment, the nozzle is disposed on the top side of the ink chamber and the direction of the membrane film displacement is parallel to the ink ejection direction.

* * * * *